US006908191B2

(12) United States Patent
Liu et al.

(10) Patent No.: US 6,908,191 B2
(45) **Date of Patent: *Jun. 21, 2005**

(54) INK JET PRINTING METHOD

(75) Inventors: Yingchun Liu, Webster, NY (US); Alexandra D. Bermel, Pittsford, NY (US); Gregory E. Missell, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 94 days.

This patent is subject to a terminal disclaimer.

(21) Appl. No.: 10/209,248

(22) Filed: Jul. 31, 2002

(65) Prior Publication Data

US 2004/0022969 A1 Feb. 5, 2004

(51) Int. Cl.[7] ..... B41M 5/00

(52) U.S. Cl. ..... 347/105; 347/106; 428/32.25; 428/32.26; 428/32.34

(58) Field of Search ..... 347/105, 106; 428/32.25, 32.26, 32.34, 32.24

(56) References Cited

U.S. PATENT DOCUMENTS 4,877,686 A 10/1989 Riou et al.
5,411,787 A * 5/1995 Kulkarni et al. ..... 428/32.11
6,495,242 B1 * 12/2002 Tsuchiya et al. ..... 428/32.24
6,623,819 B2 * 9/2003 Missell et al. ..... 428/32.25
6,623,831 B2 * 9/2003 Bauer et al. ..... 428/32.25

FOREIGN PATENT DOCUMENTS

EP 00493100 A * 7/1992
EP 01111452 A * 6/2001
JP 11291621 A * 10/1999

* cited by examiner

*Primary Examiner*—Pamela R. Schwartz
(74) *Attorney, Agent, or Firm*—Harold E. Cole; Chris P. Konkol

(57) ABSTRACT

An ink jet printing method having the steps of: A) providing an ink jet printer that is responsive to digital data signals; B) loading the printer with an ink jet recording element having a substrate having thereon: i) a subbing layer of a polymeric binder and a borate or a borate derivative, the borate or borate derivative being present in an amount of from up to about 3 g/m$^2$, and the weight ratio of the polymeric binder to the borate or borate derivative is from about 0.2:1 to about 3:1; and ii) an image-receiving layer of inorganic particles and a cross-linkable polymer containing hydroxyl groups, the cross-linkable polymer being present in an amount of less than about 50 g/m$^2$, and the weight ratio of the cross-linkable polymer to the inorganic particles is from about 5:95 to about 30:70; C) loading the printer with an inkjet ink composition; and D) printing on the image-receiving layer using the ink jet ink in response to the digital data signals.

8 Claims, No Drawings

INK JET PRINTING METHOD

CROSS REFERENCE TO RELATED APPLICATIONS

Reference is made to commonly assigned, U.S. patent application Ser. No. 10/011,656 of Missell et al., filed Dec. 4, 2001, entitled "Ink Jet Recording Element" now U.S. Pat. No. 6,623,819; and application Ser. No. 10/209,246 of Liu et al., filed of even date herewith, entitled "Ink Jet Recording Element".

FIELD OF THE INVENTION

This invention relates to an inkjet printing method. More particularly, this invention relates to an ink jet printing method using a certain subbing layer for an ink jet recording element.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

It is well known that in order to achieve and maintain photographic-quality images on such an image-recording element, an ink jet recording element must:

- Be readily wetted so there is no puddling, i.e., coalescence of adjacent ink dots, which leads to non-uniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An inkjet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality but exhibit poor ink dry time. Recording elements that use porous coatings typically contain colloidal particulates and have poorer image quality but exhibit superior dry times.

While a wide variety of different types of porous image-recording elements for use with ink jet printing are known, there are many unsolved problems in the art and many deficiencies in the known products which have severely limited their commercial usefulness. A major challenge in the design of a porous image-recording layer is to be able to obtain good quality, crack-free coatings with as little non-particulate matter as possible. If too much non-particulate matter is present, the image-recording layer will not be porous and will exhibit poor ink dry times.

U.S. Pat. No. 4,877,686 relates to a recording sheet for ink jet printing wherein boric acid or its derivative is used to cause gelling in a polymeric binder containing hydroxyl groups and a filler comprising particles. However, there is a problem with this element in that the amount of boric acid used does not provide an element which, when printed with an ink jet printer, will have a fast dry time without cracking.

It is an object of this invention to provide an inkjet printing method using a recording element that has a fast dry time. It is another object of this invention to provide an ink jet printing method using a porous recording element that has good coating quality, especially reduced cracking. It is still another object of this invention to provide an ink jet printing method using an inkjet recording element that exhibits good image quality.

SUMMARY OF THE INVENTION

These and other objects are achieved in accordance with the invention which comprises an inkjet printing method comprising the steps of:

A) providing an inkjet printer that is responsive to digital data signals;

B) loading the printer with an ink jet recording element comprising a substrate having thereon:

i) a subbing layer comprising a polymeric binder and a borate or a borate derivative, the borate or borate derivative being present in an amount of from up to about 3 g/m$^2$, and the weight ratio of the polymeric binder to the borate or borate derivative is from about 0.2:1 to about 3:1; and ii) an image-receiving layer comprising inorganic particles and a cross-linkable polymer containing hydroxyl groups, the cross-linkable polymer being present in an amount of less than about 50 g/m$^2$, and the weight ratio of the cross-linkable polymer to the inorganic particles is from about 5:95 to about 30:70;

C) loading the printer with an inkjet ink composition; and

D) printing on the image-receiving layer using the ink jet ink in response to the digital data signals.

The ink jet an inkjet printing method of the invention provides a recording element that has good coating and image quality and a fast dry time when printed in an ink jet printer.

DETAILED DESCRIPTION OF THE INVENTION

The polymeric binder in the subbing layer employed in the invention is preferably a water soluble or water dispersible polymer such as poly(vinyl alcohol), poly(vinyl pyrrolidone), gelatin, a cellulose ether, a poly(oxazoline), a poly(vinylacetamide), partially hydrolyzed poly(vinyl acetate/vinyl alcohol), poly(acrylic acid), poly(acrylamide), poly(alkylene oxide), a sulfonated or phosphated polyester or polystyrene, casein, zein, albumin, chitin, chitosan, dextran, pectin, a collagen derivative, collodian, agar-agar, arrowroot, guar, carrageenan, tragacanth, xanthan, rhamsan and the like; a latex such as poly(styrene-co-butadiene), a polyurethane latex, a polyester latex, or a poly(acrylate), poly(methacrylate), poly(acrylamide) or copolymers thereof. In a preferred embodiment, the polymeric binder is poly(vinyl alcohol), a sulfonated polyester dispersion, such as AQ29® (Eastman Chemical Co.), gelatin, a polyurethane or poly(vinyl pyrrolidone).

The polymeric binder for the subbing layer is preferably used in an amount of up to about 3 g/m$^2$.

The borate or borate derivative employed in the subbing layer of the ink jet recording element employed in the invention may be, for example, borax, sodium tetraborate, boric acid, phenyl boronic acid, or butyl boronic acid. As noted above, the borate or borate derivative is used in an amount of up to about 3 g/m$^2$. It is believed that upon coating, the borate or borate derivative in the subbing layer diffuses into the image-receiving layer to cross-link the cross-linkable binder in the image-receiving layer.

The inorganic particles which may be used include, for example, comprise metal oxides, hydrated metal oxides, boehmite, clay, calcined clay, calcium carbonate, -aluminosilicates, zeolites or barium sulfate. In a preferred embodiment, the metal oxide is silica, alumina, zirconia or titania. In another preferred embodiment, the metal oxide is fumed silica, fumed alumina, colloidal silica or boehmite. In still another preferred embodiment, the inorganic particles are present in the image-receiving layer in an amount of up to about 50 g/m$^2$.

When the inorganic particles are fumed silica or fumed alumina, they preferably have a primary particle size up to about 50 nm, but can be aggregated to give an aggregate size of less than about 300 nm. When the inorganic particles are colloidal silica or boehmite, they preferably have a particle size of less than about 150 nm.

The cross-linkable polymer containing hydroxyl groups employed in the image-receiving layer may be, for example, poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, hydroxy cellulose ethers such as hydroxyethylcellulose, etc. In a preferred embodiment, the cross-linkable polymer containing hydroxyl groups is poly(vinyl alcohol) or partially hydrolyzed poly(vinyl acetate/vinyl alcohol).

An additional polymeric binder, such as any of the polymeric binders listed above for the subbing layer, may also be added to the image-receiving layer along with the cross-linkable polymer, if desired.

The amount of binder used in the image-receiving layer should be sufficient to impart cohesive strength to the ink jet recording element, but should also be minimized so that the interconnected pore structure formed by the particles is not filled in by the binder.

In addition to the image-receiving layer, the recording element employed in the invention may also contain a layer on top of the image-receiving layer, the function of which is to provide gloss. Materials useful for this layer include sub-micron inorganic particles and/or polymeric binder.

The support for the inkjet recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof The papers listed above include a broad range of papers, from high end papers, such as photographic paper to low end papers, such as newsprint.

The support used in the invention may have a thickness of from about 50 to about 500 $\mu$m, preferably from about 75 to 300 $\mu$m. Antioxidants, antistatic agents, plasticizers and other known additives may be incorporated into the support, if desired.

In order to improve the adhesion of the image-receiving layer to the support, the surface of the support may be subjected to a corona-discharge treatment prior to applying the subbing layer.

The above coating composition can be coated either from water or organic solvents, however water is preferred. The total solids content should be selected to yield a useful coating thickness in the most economical way, and for particulate coating formulations, solids contents from 10–40 wt. % are typical.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published December 1989, pages 1007 to 1008. Slide coating is preferred, in which the base layers and overcoat may be simultaneously applied. After coating, the layers are generally dried by simple evaporation, which may be accelerated by known techniques such as convection heating.

The coating composition may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed.

The image-receiving layer thickness may range from about 1 to about 60 $\mu$m, preferably from about 5 to about 40 $\mu$m.

After coating, the ink jet recording element may be subject to calendering or supercalendering to enhance surface smoothness. In a preferred embodiment of the invention, the ink jet recording element is subject to hot soft-nip calendering at a temperature of about 65° C. and a pressure of 14000 kg/m at a speed of from about 0.15 m/s to about 0.3 m/s.

In order to impart mechanical durability to an ink jet recording element, additional crosslinkers that further act upon the cross-linkable binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30 wt. % active coating aid based on the total solution weight. These coating aids can be nonionic, anionic, cationic or amphoteric. Specific examples are described in MCCUTCHEON's Volume 1: Emulsifiers and Detergents, 1995, North American Edition.

Ink jet inks used to image the recording elements employed in the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

The following examples are provided to illustrate the invention.

EXAMPLES

Example 1

Subbing Layer 1

Sulfonated polyester dispersion AQ29® (Eastman Chemical Co.) and borax (sodium tetraborate decahydrate), at a 70:30 ratio, were used to prepare a coating solution. The coating solution was bead-coated at 25° C. on polyethylene-coated paper base that had been previously subjected to corona discharge treatment. The recording element was then dried by forced air at 43° C. for 4 minutes. The thickness of the subbing layer was 3.8 g/m$^2$.

Subbing Layer 2

This subbing layer was prepared the same as for Subbing Layer 1 except that the ratio of AQ29® to borax was 50:50.

Subbing Layer 3

This subbing layer was prepared the same as for Subbing Layer 1 except that Witco 240® (Uniroyal Chemical Co.) was used in place of AQ29 ®.

Subbing Layer 4

This subbing layer was prepared the same as for Subbing Layer 2 except that poly(vinyl alcohol) Airvol® 103 (Uniroyal Chemical Co.) was used in place of AQ29®). The thickness of the subbing layer was 0.26 g/m$^2$.

Element 1 of the Invention

A coating solution for the image-receiving layer was prepared by mixing 74 g of fumed silica Cab-O-Sperse® PG022 (Cabot Corp.) as a 20% solution, 25.1 g of poly(vinyl alcohol) Gohsenol® GH-17 (Nippon Gohsei Co. Ltd.) as a 10% solution, and 0.9 g of Olin® 10G (Dixie Chemical Co.) as a 10% solution. The solid of the coating solution was 17.4 wt. %. The coating solution was bead-coated at 25° C. on Subbing Layer 1 and dried by forced air at 21° C. The thickness of the image-receiving layer was 50 g/m$^2$.

Element 2 of the Invention

This element was prepared the same as Element 1 except that 75.8 g of fumed silica Cab-O-Sperse® PG022 (Cabot Corp.) as a 20% solution, 27.2 g of poly(vinyl alcohol) Gohsenol® GH-17 (Nippon Gohsei Co. Ltd.) as a 10% solution, and 0.95 g of Olin® 10G (Dixie Chemical Co.) as a 10% solution were used.

Element 3 of the Invention

This element was prepared the same as Element 1 except that 75.8 g of fumed silica Cab-O-Sperse® PG022 (Cabot Corp.) as a 20% solution, 33.4 g of poly(vinyl alcohol) Gohsenol® GH-17 (Nippon Gohsei Co. Ltd.) as a 10% solution, and 0.95 g of Olin® 10G (Dixie Chemical Co.) as a 10% solution were used.

Element 4 of the Invention

A coating solution for the image-receiving layer was prepared by mixing 449.5 g of fumed alumina W440® (DeGussa Corp.) as a 40% solution, 220 g of poly(vinyl alcohol) Gohsenol® GH-17 (Nippon Gohsei Co. Ltd.) as a 10% solution, and 2 g of Olin® 10G (Dixie Chemical Co.) as a 10% solution. The solids concentration of the coating solution was adjusted to 17.4 wt. % by adding water. The coating solution was bead-coated at 25° C. on Subbing Layer 1 and dried by forced air at 21° C. The thickness of the image-receiving layer was 53 gm$^2$.

Element 5 of the Invention

A coating solution for the image-receiving layer was prepared by mixing 75.8 g of Cab-O-Sperse® PG002 (Cabot Corp.) as a 20% solution, 33.4 g of poly(vinyl alcohol) Gohsenol® GH-17 (Nippon Gohsei Co. Ltd.) as a 10% solution, and 0.95 g of Olin® 10G (Dixie Chemical Co.) as a 10% solution. The coating solution was bead-coated at 25° C. on Subbing Layer 1 and dried by forced air at 21° C. The thickness of the image-receiving layer was 50 g/m$^{2'}$.

Element 6 of the Invention

This element was prepared the same as Element 1 except that 75.8 g of fumed silica Cab-O-Sperse® PG022 (Cabot Corp.) as a 20% solution, 43.4 g of poly(vinyl alcohol) Gohsenol® GH-17 (Nippon Gohsei Co. Ltd.) as a 10% solution, and 0.95 g of Olin® 10G (Dixie Chemical Co.) as a 10% solution were used.

Element 7 of the Invention

This element was prepared the same as Element 1 except that 19.9 g of colloidal silica Nalco® 1056 (Nalco Corp.) as a 30% solution, 15 g of poly(vinyl alcohol) Gohsenol® GH-17 (Nippon Gohsei Co. Ltd.) as a 10% solution, and 0.38 g of Olin® 10G (Dixie Chemical Co.) as a 10% solution were used.

Element 8 of the Invention

This element was prepared the same as Element 4 except that the solution was coated on Subbing Layer 2.

Element 9 of the Invention

This element was prepared the same as Element 4 except that the solution was coated on Subbing Layer 3.

Element 10 of the Invention

This element was prepared the same as Element 4 except that the solution was coated on Subbing Layer 4.

Comparative Element 1 (No Subbing Layer)

A coating solution for the image-receiving layer was prepared by mixing 42.25 g of Cab-O-Sperse® PG022 (Cabot Corp.) as a 20% solution, 15 g of poly(vinyl alcohol) Gohsenol® GH-17 (Nippon Gohsei Co. Ltd.) as a 10% solution, and 0.5 g of Olin® 10G (Dixie Chemical Co.) as a 10% solution. The coating solution was bead-coated at 25° C. on polyethylene-coated paper base that had been previously subjected to corona discharge treatment, and dried by forced air at 21° C. The thickness of the image-receiving layer was 50 g/m$^2$.

Comparative Element 2 (No Subbing Layer)

This element was prepared the same as Comparative Element 1 except that 37.25 g of fumed silica Cab-O-Sperse® PG022 (Cabot Corp.) as a 20% solution and 25 g of poly(vinyl alcohol) Gohsenol® GH-17 (Nippon Gohsei Co. Ltd.) as a 10% solution were used.

Comparative Element 3 (No Subbing Layer)

This element was prepared the same as Comparative Element 1 except that 32.25 g of fumed silica Cab-O-Sperse® PG022 (Cabot Corp.) as a 20% solution and 35 g of poly(vinyl alcohol) Gohsenol® GH-17 (Nippon Gohsei Co. Ltd.) as a 10% solution were used.

Comparative Element 4 (No Subbing Layer)

This element was prepared the same as Comparative Element 1 except that 29.75 g of fumed silica Cab-O-Sperse® PG022 (Cabot Corp.) as a 20% solution and 40 g of poly(vinyl alcohol) Gohsenol® GH-17 (Nippon Gohsei Co. Ltd.) as a 10% solution were used.

Comparative Element 5 (No Subbing Layer)

This element was prepared the same as Comparative Element 1 except that 19.9 g of fumed silica Nalco® 1056 (Nalco Corp.) as a 30% solution, 15 g of poly(vinyl alcohol) Gohsenol® GH-17 (Nippon Gohsei Co. Ltd.) as a 10% solution, and 0.38 g of Olin® 10G (Dixie Chemical Co.) as a 10% solution were used.

Comparative Element 6

This element was prepared the same as Element 4, except that no borax was used in the subbing layer.

Comparative Element 7

This element was prepared the same as Element 4, except that no AQ29®) was used in the subbing layer.

Coating Quality

The above dried coatings for visually evaluated for cracking defects. The results are tabulated in Table 1.

TABLE 1

| Recording Element | Subbing Layer | Ratio Particles:Polymer | Coating Quality |
|---|---|---|---|
| 1 | 1 | 85:15 | Good |
| 2 | 1 | 85:15 | Good |
| 3 | 1 | 82:18 | Good |
| 4 | 1 | 89:11 | Good |
| 5 | 1 | 82:18 | Good |
| 6 | 1 | 78:22 | Good |
| 7 | 1 | 80:20 | Good |
| 8 | 2 | 90:10 | Good |
| 9 | 3 | 90:10 | Good |
| 10 | 4 | 90:10 | Good |
| Comparative 1 | none | 85:15 | Bad |
| Comparative 2 | none | 75:25 | Bad |

TABLE 1-continued

| Recording Element | Subbing Layer | Ratio Particles:Polymer | Coating Quality |
|---|---|---|---|
| Comparative 3 | none | 65:35 | Bad |
| Comparative 4 | none | 60:40 | Good |
| Comparative 5 | none | 80:20 | Bad |
| Comparative 6 | AQ29 ® only | 90:10 | Bad |
| Comparative 7 | borax only | 90:10 | Bad |

The results show that the elements employed in the invention had better coating quality than all but one of the comparative elements. While Comparative Element 4 had good coating quality, it contained 40 wt. % binder as compared to less than 25 wt. % binder for the elements of the invention, and was worse for coalescence as will be shown in Example 2.

Example 2

Preparation of Inks

Cyan Ink

A cyan ink was prepared using Pigment Blue 15:3 at 1.4 wt. %, sulfonated polyester dispersion AQ55® (Eastman Chemical Co.) at 1.1 wt. %, glycerol at 6.0 wt. %, Surfynol® 465 at 0.2 wt. %, Dowanol® EB (Dow Chemical Co.) at 2.5 wt. % and diethylene glycol at 24.0 wt. %. Small amounts of triethanol amine and lactic acid were used to adjust the pH to 8.

Magenta Ink

A magenta ink was prepared using Pigment Red 122 at 2.2 wt. %, sulfonated polyester dispersion AQ55® (Eastman Chemical Co.) at 2.0 wt %, glycerol at 6.0 wt. %, Surfynol® 465 at 0.2 wt. %, Dowanol EB (Dow Chemical Co.) at 2.5 wt. % and diethylene glycol at 19.4 wt. %. Small amounts of triethanol amine and lactic acid were used to adjust the pH to 8.

Yellow Ink

A yellow ink was prepared using Pigment Yellow 155 at 2.2 wt. %, sulfonated polyester dispersion AQ55® (Eastman Chemical Co.) at 2.0 wt. %, glycerol at 6.0 wt. %, Surfynol® 465 at 0.2 wt. %, Dowanol® EB at 2.5 wt. % and diethylene glycol at 20 wt. %. Small amounts of triethanol amine and lactic acid were used to adjust the pH to 8.

Black Ink

A black ink was prepared using Pigment Black 7 at 1.6 wt. % of the ink composition, sulfonated polyester dispersion AQ55® (Eastman Chemical Co.) at 1.485 wt. %, glycerol at 6.0 wt. %, Surfynol® 465 at 0.2 wt. %, Dowanol® EB at 2.5 wt. % and diethylene glycol at 23 wt. %. Small amounts of triethanol amine and lactic acid were used to adjust the pH to 8.

Printing

The above inks were filtered through a 0.2 $\mu$m polytetrafluoroethylene filter, degassed using ultrasonic treatment with an applied vacuum of 559 mm of mercury and placed in a clean empty cartridge used for printing with a Mutoh 4100 inkjet printer. The above inks were printed on Recording Elements 1–10 and Comparative Element 4 using a Mutoh 4100 ink jet printer without color correction at 283 dots per centimeter (720 dpi) bi-directional printing, with "microdot on" setting giving a droplet size of about 17 picoliters.

The test image consisted of a block 9.2 cm by 19.4 cm, divided into equally sized patches 0.7 cm by 0.4 cm to give 40 rows of patches and 12 columns of patches. The rows were numbered from 10 to 400 in increments of 10 to indicate the increasing percentage of ink laydown. Thus, patches 10 to 100 were printed with one ink, patches 110 to 200 were printed with two inks, patches 210 to 300 were printed with three inks and patches 310 to 400 were printed with four inks. The columns were labeled with the order of ink laydown for cyan, magenta, yellow and black inks as shown in Table 2.

TABLE 2

| | Order of Ink Laydown | | | |
|---|---|---|---|---|
| Column | Rows 10–100 | Rows 110–200 | Rows 210–300 | Rows 310–400 |
| 1 | K | KCMY | KCMY | KCMY |
| 2 | CMYK | CMYK | CMYK | CMYK |
| 3 | CMY | CMYK | CMYK | CMYK |
| 4 | Y | YCM | YCM | None |
| 5 | M | MCY | MCY | None |
| 6 | C | CMY | CMY | None |
| 7 | Y | YM | YMK | YMKC |
| 8 | Y | YC | YCK | YCKM |
| 9 | M | MY | MYC | None |
| 10 | M | MC | MCK | MCKY |
| 11 | C | CY | CYM | None |
| 12 | C | CM | CMY | None |

Coalescence

Coalescence varies depending on the order in which inks are printed. Coalescence was evaluated by visual inspection of each of the printed recording elements. The first row in which puddling on the surface appears was recorded. Values greater than about 150 are desirable. The results are shown in Table 3.

TABLE 3

| Printed Recording Element | Subbing Layer | Ratio Particles:Polymer | Coalescence |
|---|---|---|---|
| 1 | 1 | 85:15 | 400 |
| 2 | 1 | 85:15 | 280 |
| 3 | 1 | 82:18 | 290 |
| 4 | 1 | 89:11 | 380 |
| 5 | 1 | 82:18 | 220 |
| 6 | 1 | 78:22 | 200 |
| 8 | 2 | 90:10 | 390 |
| 9 | 3 | 90:10 | 260 |
| 10 | 4 | 90:10 | 180 |
| Comparative 4 | none | 60:40 | 130 |

The results show that the elements employed in the invention were better for coalescence than Comparative Element 4.

This invention has been described with particular reference to preferred embodiments thereof but it will be understood that modifications can be make within the spirit and scope of the invention.

What is claimed is:

1. An ink jet printing method comprising the steps of:

A) providing an ink jet printer that is responsive to digital data signals;

B) loading said printer with an ink jet recording element comprising a substrate having coated thereon:

i) a subbing layer comprising a sulfonated polyester dispersion as a polymeric binder, and a borate or a borate derivative, said borate or borate derivative being present in an amount up to 3 g/m$^2$ and wherein said polymeric binder is present in said subbing layer in an amount of up to 3 g/m$^2$, and the weight ratio of said polymeric binder to said borate or borate derivative is from 0.2:1 to 3:1; and when coated onto the substrate ii) an image-receiving layer formed by coating onto said subbing layer a composition comprising inorganic particles and a cross-linkable polymer containing hydroxyl groups, said cross-linkable polymer being present in an amount of less than 50 g/m$^2$, and the weight ratio of said cross-linkable polymer to said inorganic particles is from 5:95 to 30:70, and allowing said borate or borate derivative in the subbing layer to diffuse into the image-receiving layer to cross-link the cross-linkable polymer in the image-receiving layer;

C) loading said printer with an ink jet ink composition; and

D) printing on said image-receiving layer using said ink jet ink in response to said digital data signals.

2. The method of claim 1 wherein said borate or borate derivative is borax, sodium tetraborate, boric acid, phenyl boronic acid, or butyl boronic acid.

3. The method of claim 1 wherein said inorganic particles are present in said image-receiving layer in an amount of up to about 25 g/m$^2$.

4. The method of claim 1 wherein said inorganic particles comprise metal oxides, hydrated metal oxides, boehmite, clay, calcined clay, calcium carbonate, aluminosilicates, zeolites or barium sulfate.

5. The method of claim 4 wherein said metal oxide is silica, alumina, zirconia or titania.

6. The method of claim 4 wherein said metal oxide is fumed silica, fumed alumina, colloidal silica or boehmite.

7. The method of claim 1 wherein said cross-linkable polymer containing hydroxyl groups in said image-receiving layer comprises poly(vinyl alcohol), partially hydrolyzed poly(vinyl acetate/vinyl alcohol), copolymers containing hydroxyethylmethacrylate, copolymers containing hydroxyethylacrylate, copolymers containing hydroxypropylmethacrylate, or hydroxy cellulose ethers.

8. The method of claim 1 wherein said cross-linkable polymer containing hydroxyl groups in said image-receiving layer comprises poly(vinyl alcohol) or partially hydrolyzed poly(vinyl acetate/vinyl alcohol).

* * * * *